US007367206B2

(12) United States Patent
Asada et al.

(10) Patent No.: US 7,367,206 B2
(45) Date of Patent: May 6, 2008

(54) DRY-CLEANING MACHINE

(75) Inventors: Nobuhiro Asada, Moriguchi (JP); Mitsuru Naganawa, Moriguchi (JP); Masafumi Nishino, Moriguchi (JP)

(73) Assignee: Sanyo Electric Co., Ltd., Osaka (JP)

( * ) Notice: Subject to any disclaimer, the term of this patent is extended or adjusted under 35 U.S.C. 154(b) by 578 days.

(21) Appl. No.: 10/665,555

(22) Filed: Sep. 22, 2003

(65) Prior Publication Data

US 2004/0065125 A1 Apr. 8, 2004

(30) Foreign Application Priority Data

Oct. 4, 2002 (JP) ..... 2002-292242

(51) Int. Cl.
*D06F 35/00* (2006.01)
*D06F 43/00* (2006.01)

(52) U.S. Cl. ..... 68/18 F; 8/142

(58) Field of Classification Search ..... 68/12.08, 68/12.09, 18 R, 18 F; 210/DIG. 5
See application file for complete search history.

(56) References Cited

U.S. PATENT DOCUMENTS 3,692,467 A * 9/1972 Durr et al. ..... 8/158
4,335,001 A * 6/1982 Aurelle et al. ..... 210/708
4,664,754 A * 5/1987 Caputi et al. ..... 203/39
4,707,269 A * 11/1987 Ohue et al. ..... 210/651
5,213,594 A * 5/1993 Cannon et al. ..... 95/90
6,059,845 A * 5/2000 Berndt et al. ..... 8/142
6,086,635 A * 7/2000 Berndt et al. ..... 8/142
2003/0070238 A1* 4/2003 Radomyselski et al. ..... 8/137
2003/0196282 A1* 10/2003 Fyvie et al. ..... 15/3

OTHER PUBLICATIONS http://www.sanyo.co.jp/techno-c/clean/catalog_top.html (Feb. 17, 2002).

* cited by examiner

*Primary Examiner*—Michael Barr
*Assistant Examiner*—Jason P. Riggleman
(74) *Attorney, Agent, or Firm*—Oliff & Berridge, PLC

(57) ABSTRACT

The present invention provides a dry-cleaning machine capable of performing a water-repellent finishing process when necessary, while ensuring a high level of safety. When the water-repellent finishing process has been performed after the drying process (Step S2), the solvent contained in the water repellent penetrates into the laundry articles. Taking this into account, the upper limit for the temperature difference ?T between the inlet and outlet of the drum detected is set lower (e.g. 10° C.) than that the upper limit (e.g. 20° C.) applied to the case where no water-repellent finishing process is performed. This temperature setting reduces the amount of heat supplied to the laundry articles and accordingly decreases the evaporating speed of the solvent. Thus, the concentration of the gasified solvent in the air-circulating passage is maintained under the safety level. In this case, the time period for the drying operation is set longer to compensate for the deterioration in the drying efficiency.

4 Claims, 5 Drawing Sheets

NORMAL STATE

ABNORMAL PRESSURE

DRY-CLEANING MACHINE

BACKGROUND OF THE INVENTION

Conventional dry-cleaning machines generally use petroleum solvents for washing. Examples of this type of dry-cleaning machines are disclosed in the Online Catalogue of SANYO Electric Techno Clean Co., Ltd., published on the WWW site located at: http://www.sanyo.co.jp/techno-c/clean/catalogue_top.html.

Recently, however, silicone solvents have been used more and more because, compared to petroleum solvents, they are less harmful to the environment, to the health of the worker using the machine, and to the health of the owner of the laundry article, who may suffer from solvent remaining in the laundry article.

Recently, water-repellent finishing is often performed within a cleaning process according to the request from the customer. By conventional dry-cleaning machines that continuously perform washing through drying, however, it is impossible to carry out the water-repellent finishing. The main reason for this is that water repellents used for that process consist of a small amount of a water-repellent resin mixed into a solvent. Therefore, spraying the water repellent onto laundry articles before the drying process will increase the amount of the solvent held in the laundry articles, which in turn increases the concentration of the solvent and makes the solvent highly inflammable during the drying process. With regard to the inflammability, silicone solvents, whose flash point is 77 degrees centigrade, is safer than petroleum solvents, whose the flash point is 53 degrees centigrade. Therefore, the switchover from petroleum solvents to silicone solvents provides a good reason to demand for the water-repellent finishing to be performed by dry-cleaning machines. Use of silicone solvents, however, cannot completely eliminate the possibility of explosion. Therefore it is still necessary to take appropriate measures to provide a high level of safety even when a silicone solvent is used in a dry-cleaning machine.

The basic construction of dry-cleaning machines using silicone solvents is the same as that of dry-cleaning machines using petroleum solvents. However, some points must be considered with respect to the difference in characteristics and features between the two solvents. For example, silicone solvents are far more costly than petroleum solvents, and accordingly increase the running cost. On the presumption that petroleum solvents are used, conventional dry-cleaning machines are constructed to allow a part of the solvent, volatilized during the drying process, to escape from the machine. In the case of using a silicone solvent, however, dry-cleaning machines should be constructed to recover as much solvent as possible to decrease the amount of the solvent to be replenished.

In the recovering and drying process, the water and solvent are condensed, liquefied and recovered as a mixture, which is then separated back into water and solvent with a water separation filter. The specific gravities of petroleum solvents are about 0.8, which significantly differs from that of water. With such a large difference in specific gravity, the water can be easily separated from the solvent. The specific gravities of silicone solvents, on the other hand, are about 0.95, which is considerably close to that of water. Though the small difference in specific gravity can still help with the separation of the water from the solvent, the separation takes such a long time that it cannot follow the cycle of the drying process of the machine. Therefore, it is necessary to use a new water separation filter capable of separating water from silicone solvents at a speed comparable to the operation cycle of the machine.

In view of the above problems, the first objective of the present invention is to provide a dry-cleaning machine capable of performing the water repellent finishing while ensuring a high level of safety. The second objective of the present invention is to provide a dry-cleaning machine capable of efficiently recovering the solvent to reduce the running cost. The third objective of the present invention is to provide a dry-cleaning machine capable of separately recovering the water and the solvent in a short time even in the case of using a silicone solvent or a similar solvent having a specific gravity close to that of water.

SUMMARY OF THE INVENTION

To solve the aforementioned problems, the present invention provides, as the first invention, a dry-cleaning machine for sequentially performing:

a washing process for washing laundry articles contained in a washing/drying tub with a solvent;

an extracting process for extracting the solvent from the laundry articles; and a recovering and drying process for forming an air-circulating passage, for producing a circulation of air through the air-circulating passage, and for supplying hot air into the washing/drying tub and cooling the air exiting from the washing/drying tub to liquefy, condense and recover the gasified solvent contained in the air while the air is circulating through the air-circulating passage, which includes:

a) a water repellent dispenser for dispensing a water repellent into the washing/drying tub;

b) a commanding device for entering a command for optionally adding a water-repellent finishing process in which the water repellent is dispensed by the water repellent dispenser; and c) an operation controller, operating in response to the command made by the commanding device, for adding the water-repellent finishing process between the extracting process and the drying and recovering process, and for performing a heating control whereby the hot air supplied into the washing/drying tub during the recovering and drying process is made to have a smaller amount of heat when the water-repellent finishing process is added.

To perform the water-repellent finishing with the dry-cleaning machine according to the first invention, the worker should do necessary tasks, such as the preparation of the water repellent, and then operate the commanding device to enter a command for adding the water-repellent finishing process. Given this command, the operation controller activates the water repellent dispenser to dispense the water repellent into the washing/drying tub and coat the laundry articles with the water repellent after the extracting process is completed. A water repellent generally contains a small amount of water-repellent resin dissolved in a solvent. Therefore, when the water-repellent finishing is performed, the amount of solvent held in the laundry articles after the extracting process increases by the amount of the water repellent. Accordingly, compared to the case where the water-repellent finishing is not performed, a greater amount of solvent evaporates from the laundry articles during the recovering and drying process, particularly in its initial phase. Thus, the concentration of the gasified solvent in the air is likely to increase within the air-circulating passage (exactly speaking, within a part of the passage between the inside of the washing/drying tub and the point where the solvent is recovered.) To address this problem, the operation controller performs a heating control whereby the hot air supplied into the washing/drying tub is made to have a smaller amount of heat when the water-repellent finishing process is performed than when the process is not performed. For example, when the heater for heating the air is a steam-heating type, the heater is controlled so that it produces a smaller amount of steam. This operation suppresses the evaporating speed of the solvent even when the laundry articles contain a relatively large amount of the solvent, so that the concentration of the gasified solvent in the air can be assuredly maintained lower than a safety value under which an ignition or similar accident does not occur.

Thus, the dry-cleaning machine according to the first invention can perform a water repellent finishing process when necessary, while ensuring a high level of safety.

In a mode of the first invention, the dry-cleaning machine further includes:

a first temperature detector for detecting the temperature of the air at an inlet port of the washing/drying tub; and a second temperature detector for detecting the temperature of the air at an outlet port of the washing/drying tub, and the operation controller performs the heating control so that the difference between the two temperatures detected by the first and second temperature detectors is maintained equal to or less than a predetermined value, where the predetermined value is set smaller when the water-repellent finishing process is performed than when the water-repellent finishing process is skipped.

In this mode, when hot air is passing through the washing/drying tub from the inlet port to the outlet port, the operation controller maintains the temperature difference between the inlet port and the outlet port at a constant value to maintain the concentration of the gasified solvent under the safety level. This technique, which the applicant has named the "enthalpy control method", has been already applied to some dry-cleaning machines and solvent-recovering dryers. In the present invention, the upper limit value for the temperature difference is changed according to whether or not the water-repellent finishing process is performed. This method assuredly maintains the concentration of the gasified solvent under the safety level.

To solve the aforementioned problems, the present invention provides, as the second invention, a dry-cleaning machine, including:

a drying tub for containing laundry articles washed with a solvent; and a duct, connected to the drying tub, for forming an air-circulating passage through which hot air flows into and exits from the drying tub, and in which the air exiting from the drying tub is cooled to liquefy and condense the gasified solvent contained in the air and to recover the solvent, which further includes:

a) a cooler for cooling the air exiting from the drying tub to condense and liquefy the solvent contained in the air within the duct;

b) an exhaust port located downstream of the cooler, which port connects the inside and the outside of the duct;

c) a sluice valve, located in the duct at a position downstream of the exhaust port, for opening and closing the duct;

d) an intake port having an opening and closing mechanism, which port connects the inside and the outside of the duct at a position downstream of the sluice valve; and e) a heater located within the duct at a position downstream of the intake port and upstream of the drying tub, whereby the cooler is activated to recover the solvent during a part or entirety of an exhausting and drying period in which the intake port is opened to introduce ambient air into the duct while a part or entirety of the air exiting from the drying tub is exhausted through the exhaust port to the outside.

The dry-cleaning machine according to the second invention initially performs, for example, a recovering and drying process. In this process, the intake port is closed and the sluice valve is opened. Under this condition, hot air produced by the heater is supplied into the drying tub, where the air evaporates the solvent from the laundry articles. Then, the air containing the solvent leaves the drying tub and reaches the cooler, which cools the air to condense and liquefy the solvent. In this stage, since no air is externally introduced into the duct, the air from which the solvent has been removed barely escapes through the exhaust port to the outside even when the exhaust port is opened to the ambient air. Consequently, almost all the air returns through the sluice valve to the heater. Thus, a circulation of air is produced. Also, the condensed and liquefied solvent is recovered in the recovering and drying process.

After the laundry articles have been dried to a certain extent, the intake port is opened to introduce the ambient air. At this moment, if the sluice valve is opened, a part of the air exiting from the drying tub is emitted through the exhaust port to the outside, while the rest is mixed with the ambient air introduced through the intake port, and returns through the sluice valve to the heater. If, on the other hand, the sluice valve is closed, the air exiting from the drying tub is entirely discharged through the exhaust port to the outside. In any case, the air exiting from the drying tub necessarily passes through the cooler located upstream of the exhaust port. Therefore, by activating the cooler, the solvent contained in the air can be cooled, condensed and recovered as liquid.

Thus, the second invention considerably reduces the amount of the solvent discharged with the air through the exhaust port to the outside. The improvement in the efficiency of recovering the solvent makes it possible to decrease the replenishment of the solvent. Therefore, the running cost can be lower than conventional cases even when an expensive solvent, such as a silicone solvent, is used. Furthermore, the invention improves the working environment for the worker by reducing the amount of the solvent leaking from the machine to the ambient air.

In a preferable mode of the second invention, the dry-cleaning machine has an exhaust valve for opening and closing the exhaust port, and the exhaust valve includes an explosion relief section that is pushed open and outward by a gas pressure in the duct if the gas pressure rapidly increases.

In the recovering and drying process, when the exhaust port is opened, a small amount of air inevitably escapes from the port, where a part of the solvent not liquefied by the cooler may also leak to the outside. The present construction effectively prevents the leakage of the solvent by closing the exhaust port during the recovering and drying process. Complete sealing of the air-circulating passage, however, may lead to a large-scale explosion if the solvent should catch fire in the air-circulating passage. According to the present construction, if the gas pressure inside the duct should rapidly increase due to an ignition, the gas pressure would push the explosion relief section of the exhaust port to open outward, and the gas would be quickly released to the outside. Thus, the influence from the explosion would be minimized.

To solve the aforementioned problems, the present invention provides, as the third invention, a dry-cleaning machine for performing a drying process whereby hot air is supplied into a drying tub containing laundry articles washed with a solvent, and the air exiting from the drying tub is cooled to liquefy, condense and recover the gasified solvent contained in the air, which includes a water separation unit for removing water from a mixture of the liquefied and condensed solvent and the water to recover the solvent with a high level of purity, where a coalescer type of filter is used as the water separation unit.

The dry-cleaning machine according to the third invention uses a coalescer type of filter as the water separation unit. This type of filter can separate the mixture into the water and the solvent at high speeds, even when the specific gravity of the solvent is close to that of the water, like silicone solvents. Therefore, the solvent can be recovered at a speed comparable to the speed of the drying operation of the machine, i.e. the speed at which the mixture is produced during the drying operation.

In a mode of the third invention, the water separation unit includes:

a tank for storing the mixture, having an inlet port located in its upper part for introducing the mixture;

a filter member immersed in the mixture stored in the tank, where the solvent is stored in a solvent storage chamber defined on one side of the filter member opposite to the mixture, and the filter member allows only the solvent contained in the mixture to pass through into the solvent storage chamber;

a solvent recovery pipe with its upper end located in the solvent storage chamber; and a drainage pipe connected to the bottom part of the tank, including:

a vertical part for bringing the water from the tank to a level higher than the bottom part of the tank, and a horizontal part located downstream of the vertical part, where the highest point within the horizontal part is lower than the upper end of the solvent recovery pipe.

In this mode, when the mixture rises to a level where the filter member is immersed, the solvent passes through the fibers of the filter member, whereas the water is condensed into large drops because the surface tension of the water on the surface of the fibers differs from that of the solvent. Then, due to the difference in specific gravity, the water drops fall and are collected at the bottom of the tank. As the level of the mixture rises, the level of the solvent in the solvent storage chamber accordingly rises, and reaches the upper end of the solvent recovery pipe. Then, the solvent flows through the solvent recovery pipe to the outside of the tank, while the water collected at the bottom of the tank flows through the drainage pipe to the outside of the tank. Thus, the solvent and the water are separated in a short time. An example of the filter member used here is a non-woven fabric structure made of superfine fibers.

In a mode of the third invention, the solvent is a silicone solvent, and the difference in level between the horizontal part of the drainage pipe and the upper end of the solvent recovery pipe is determined corresponding to the difference in specific gravity between the silicone solvent and the water. In this mode, as the mixture flows into the tank, the level of the mixture in the tank rises, and the water level in the vertical part of the drainage pipe also rises. Then, the water reaches the horizontal part, and starts flowing to the outside. When the mixture and the water have reached those levels, the solvent also starts flowing through the solvent recovery pipe to the outside. As a result, the mixture in the tank is maintained at a level where the filter member is adequately immersed in the mixture. Thus, it is possible to assuredly separate the water and the solvent to recover the solvent with a high level of purity.

In the above-described construction, after the water starts flowing through the drainage pipe to the outside, the water may continue flowing due to a siphoning effect despite the lowering of the level of the mixture. To avoid this situation, it is preferable to provide the horizontal part of the drainage pipe with a hole leading to the ambient air. Furthermore, the hole may be preferably connected to the upper part of the tank by a vent pipe. By this construction, any water leaking through the hole returns to the tank without being randomly scattered.

BRIEF DESCRIPTION OF THE DRAWINGS

In FIG. 2, the controller 40, composed of microcomputers and other elements, includes a central processing unit (CPU), a read-only memory (ROM) in which an operation control program is stored, a random access memory (RAM) for holding data necessary for the operation, and other components. Various devices are connected to the controller 40, such as an operation unit 42 having key input switches and other parts, and a display 43 having a panel for showing numerical values and other information. In addition, some of the aforementioned devices are also connected to the controller 40, which include the first temperature sensor 13, the second temperature sensor 14, the cooler temperature sensor 16, the solvent temperature sensor 25, the normal level switch 19*a*, the drainage level switch 19*b* and the soap concentration sensor 26.

DETAILED DESCRIPTION OF A PREFERRED EMBODIMENT

Figure 1:
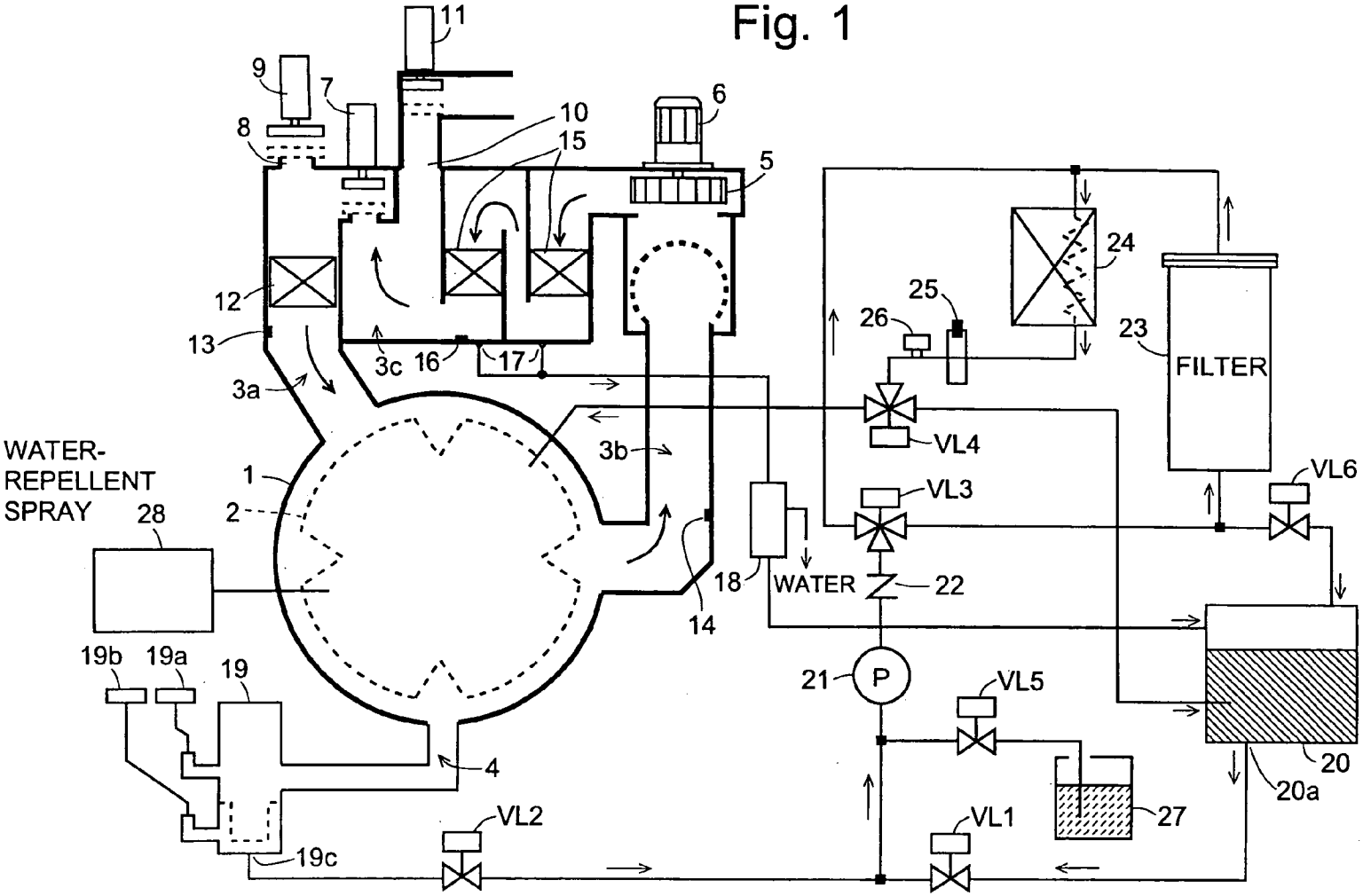
FIG. 1 shows the construction of the main part of a dry-cleaning machine as an embodiment of the present invention, focusing on the piping and the passage configuration.

An embodiment of the dry-cleaning machine according to the present invention is described. FIG. 1 shows the construction of the main part of the dry-cleaning machine, focusing on the solvent passage and the air passage.

The dry-cleaning machine has an outer tub 1, in which a cylindrical drum 2 having a number of perforations is supported by a rotating shaft. Connected to the circumferential wall of the outer tub 1 is an inlet-side duct 3*a*, an outlet-side duct 3*b* and a solvent drainage line 4. The inlet-side duct 3*a*, the outer tub 1, the outlet-side duct 3*b* and the upper duct 3*c* constitute an air-circulating passage. The blower motor 6 drives the blower 5, which pulls the air through the air-circulating passage to generate a flow of air, as shown by the arrows in FIG. 1. The air-circulating passage is opened and closed by a sluice valve 7 located between the upper duct 3*c* and the inlet-side duct 3*a*. An intake port 8 having an intake valve 9 is located immediately downstream of the sluice valve 7, and an exhaust port 10 having an exhaust valve 10 is located.

Within the inlet-side duct 3*a*, a steam-heating type of heater 12 is located as the heater mentioned earlier, and a first temperature sensor 13 is located further downstream of the heater 12. The heater 12 has a pipe (not shown), into which steam having a high temperature (normally 100-120 degrees centigrade) is supplied, when necessary, from a boiler (not shown) located outside of the dry-cleaning machine. The steam exiting the heater 12 returns to the boiler. Thus, the air passing the inlet-side duct 3*a* is heated by the heater and then supplied into the outer tub 1. In addition, another sensor (or second temperature sensor) 14 is located in the outlet-side duct 3*b*, which monitors the temperature of the air exiting the drum 2.

Within the upper duct 3*c*, two pieces of air coolers 15 as the aforementioned cooler are located upstream of the exhaust port 10, and a cooler temperature sensor 16 is located downstream of the air coolers 15. Each air cooler 15 includes a heat exchanger having a pipe, through which a coolant condensed and liquefied by a refrigerator (not shown) located outside of the dry-cleaning machine is supplied in a circulatory manner, when necessary. When the air transferred through the outlet-side duct 3*b* reaches the heat exchanger of the air cooler 15, the air is rapidly cooled. Then, the gasified solvent contained in the air is condensed into liquid, which falls onto the bottom of the duct. The liquefied solvent flows through the drainage ports 17 to the water separation unit 18, which removes water from the solvent. Thus, only the solvent is recovered in the solvent tank 20.

The drainage line 4 extending from the bottom of the outer tub 1 is connected to a button trap 19 having a normal level switch 19*a* for insuring that the solvent stored in the drum 2 is at a predetermined level and a drainage level switch 19*b* for confirming that the solvent has been completely discharged from the outer tub 1. Button trap 19 is a kind of filter for catching an object, such as a button of clothes, which may be contained in the solvent discharged from the outer tub 1. The supply port 20*a* of the solvent tank 20 and the drainage port 19*c* of the button trap 19 are connected to the suction port of the pump 21 via a supply valve VL1 and a drainage valve VL2, respectively. The exhaust port of the pump 21 is connected via a sluice valve 22 to either the inlet or outlet port of the solvent filter 23, depending on the setting of the first three-way valve VL3. The solvent filter 23 is constructed using a paper filter, an activated carbon filter or a similar filter, which removes impurities, such as fine dust, from the solvent.

The outlet port of the solvent filter 23 is connected also to the solvent cooler 24. The outlet cooler 24 includes a heat exchanger having a pipe, through which a coolant condensed and liquefied by the refrigerator is supplied in a circulatory manner, when necessary. The heat exchanger cools the solvent by a heat-exchanging mechanism. A solvent temperature sensor 25 and a soap concentration sensor 26 are located downstream of the solvent cooler 24, and the duct located further down from these sensors is connected to either the outer tub 1 or the solvent tank 20, depending on the setting of the second three-way valve VL4. A soap tank 27 is connected via a soap supply valve VL5 to the suction port of the pump 21. The inlet port of the solvent filter 23 is connected via a solvent release valve VL6 to the upper part of the solvent tank 20. In addition, a water repellent spray 28 is provided for spraying a water repellent onto the laundry articles contained in the drum 2. The water repellent consists of a small amount of a water-repellent resin dissolved in a solvent. The water repellent spray 28 is separately provided as an option to the machine because some users (i.e. dry-cleaning shops) may have no need for it.

With the solvent circulation passage constructed as described above, the solvent can be supplied into the tub 1 by the following steps: close the drainage valve VL2, open the supply valve VL1, connect the outlet port of the solvent cooler 24 via the second three-way valve VL4 to the outer tub 1, connect the exhaust port of the pump 21 via the first three-way valve VL3 to the inlet port of the solvent filter 23, and energize the pump 21. It should be noted that the solvent release valve VL6 should be closed hereby. Then, the solvent stored in the solvent tank 20 is supplied to the tub 1 through the supply valve 21, the pump 21, the first three-way valve VL3, the solvent filter 23, the solvent cooler 24 and the second three-way valve VL4. The passage thus configured is referred to as the "solvent-supplying passage" hereinafter.

The steps for discharging the solvent from the outer tub 1 are as follows: open the drainage valve VL2, close the supply valve VL1, connect the exhaust port of the pump 21 via the first three-way valve VL3 to the outlet port of the solvent filter 23, connect the outlet port of the solvent cooler 24 via the second three-way valve VL4 to the solvent tank 20, and energize the pump 21. Then, the solvent flows from the tub 1 back to the solvent tank 20 via the drainage line 4, the button trap 19, the drainage valve VL2, the pump 21, the first three-way valve VL3, the solvent filter 23, the solvent cooler 24 and the second three-way valve VL4. The passage thus configured is referred to as the "solvent-draining passage" hereinafter. In this case, the solvent filter 23 removes impurities from the solvent being transferred to the solvent tank 20. Furthermore, passing a coolant through the solvent cooler 24 will lower the temperature of the solvent.

When no solvent should be supplied into the outer tub 1, the configuration should be as follows: open the supply valve VL1, close the drainage valve VL2, connect the exhaust port of the pump 21 via the first three-way valve VL3 to the inlet port of the solvent tank 23, connect the outlet port of the solvent cooler 24 via the second three-way valve VL4 to the solvent tank 20, and energize the pump 21. Then, the solvent circulates from the solvent tank 20, through the supply valve VL1, the pump 21, the first three-way valve VL3, the solvent filter 23, the solvent cooler 24, the second three-way valve VL4, and back to the solvent tank 20. In this process, the solvent filter 23 removes impurities from the circulating solvent. Furthermore, it is possible to cool the solvent by activating the solvent cooler 24, as in the case of the solvent-draining passage.

Figure 2:
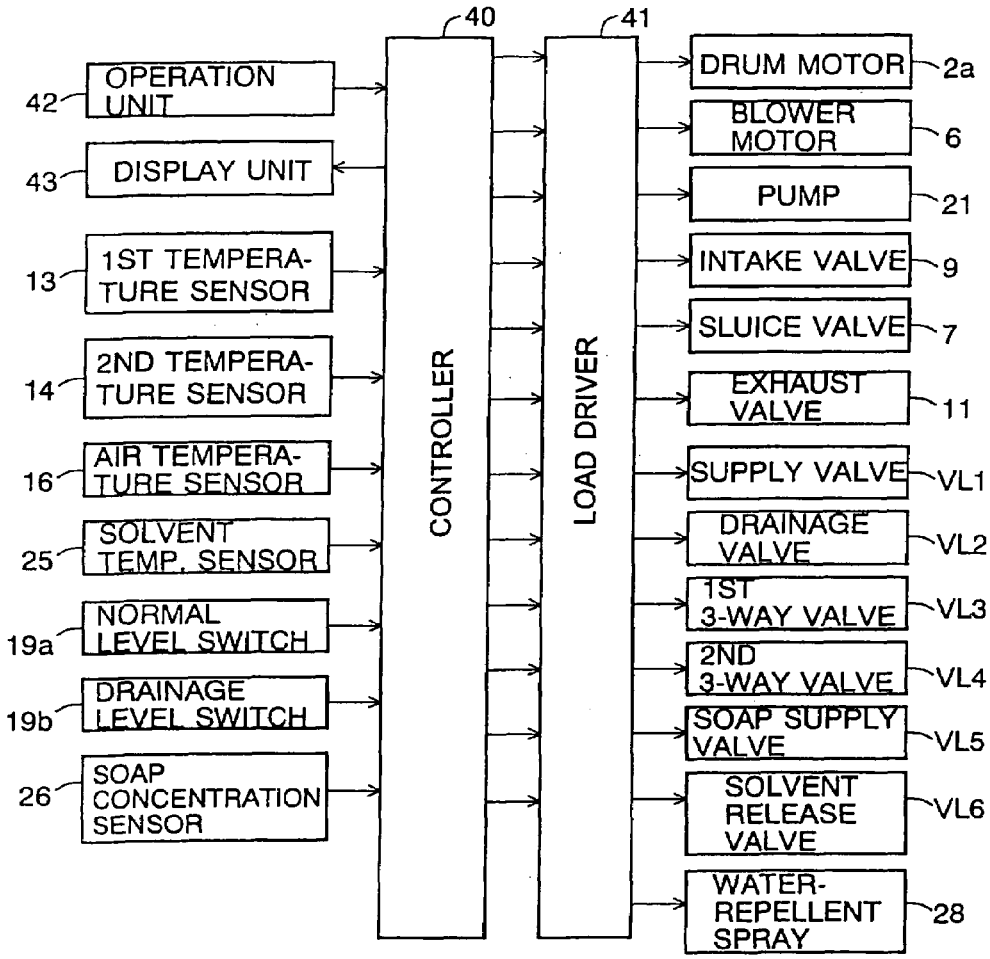
FIG. 2 shows the electrical configuration of the present dry-cleaning machine.

FIG. 2 shows the electrical configuration of the present dry-cleaning machine. In FIG. 2, the controller 40, composed of microcomputers and other elements, includes a central processing unit (CPU), a read-only memory (ROM) in which an operation control program is stored, a random access memory (RAM) for holding data necessary for the operation, and other components. Various devices are connected to the controller 40, such as an operation unit 42 having key input switches and other parts, and a display 42 having a panel for showing numerical values and other information. In addition, some of the aforementioned devices are also connected to the controller 40, which include the first temperature sensor 13, the second temperature sensor 14, the cooler temperature sensor 16, the solvent temperature sensor 25, the normal level switch 19*a*, the drainage level switch 19*b* and the soap concentration sensor 26.

Receiving various signals from the aforementioned sensors and switches, the controller 40 sends control signals to the load driver 41 according to the operation control program. In response to the signal, the load driver 41 drives the drum motor 2*a*, the blower motor 6, the pump 21, the intake valve 9, the sluice valve 7, the exhaust valve 11, the supply valve VL1, the drainage valve VL2, the first three-way valve VL3, the second three-way valve VL4, the soap supply valve VL5, the solvent release valve VL6, the water repellent spray 28 and/or other relevant devices.

Figure 3:
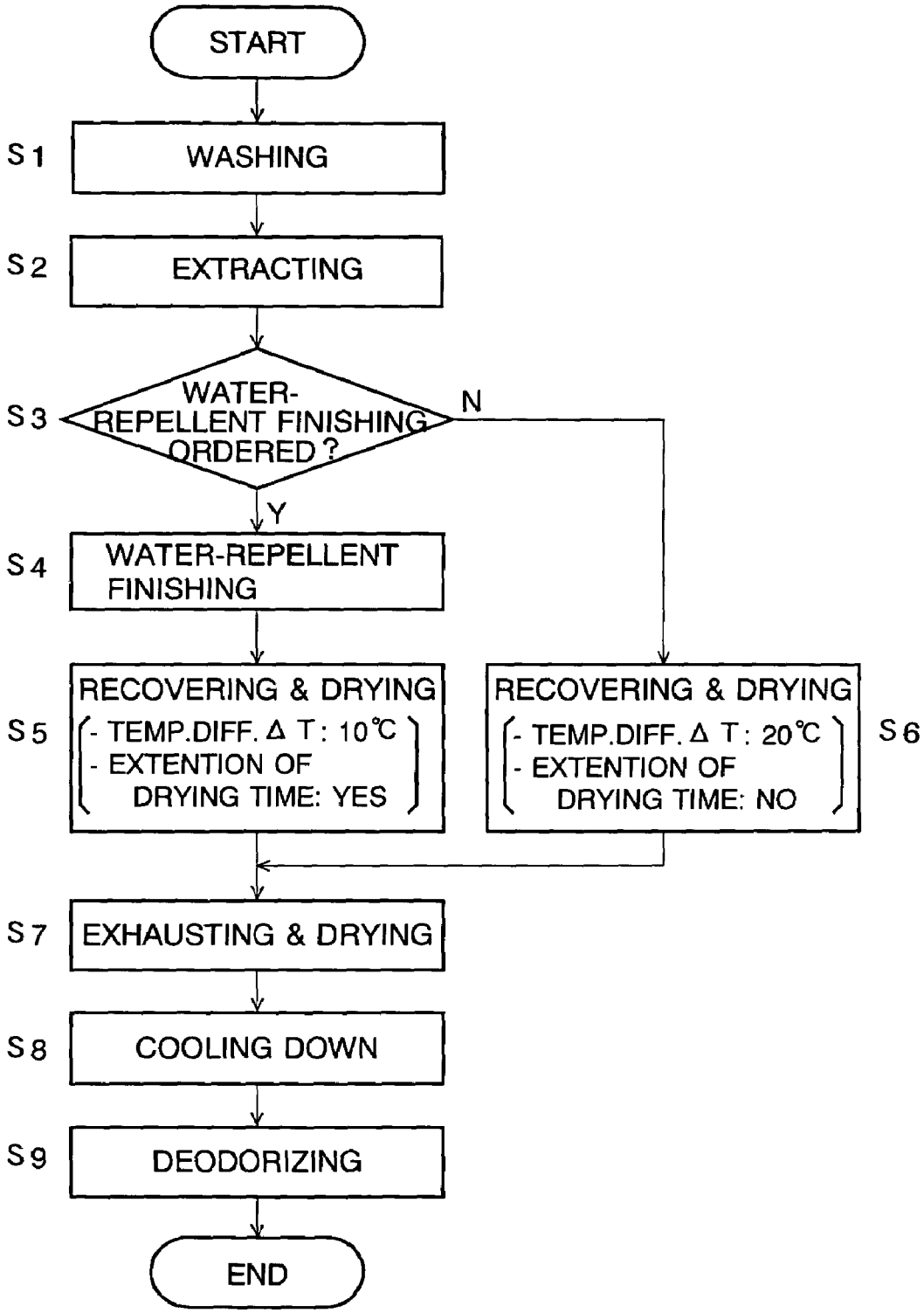
FIG. 3 is a flowchart showing the operation process of the dry-cleaning machine of the embodiment.

FIG. 3 is a flowchart showing the operation process of the present dry-cleaning machine.

(1) Washing Process (Step S1)

The worker loads the laundry articles into the drum 2 and operates the operation unit 42 by entering the setting data necessary for the operation. There, the setting for adding the water repellent finishing process should be also made, if necessary. After the setting is completed, the worker presses the start key provided in the operation unit 42 to signal the machine to start the operation. Then, the controller 40 drives the motor 2*a* to intermittently rotate the drum 2 back and forth at a low speed (e.g. 30-50 r.p.m.) Simultaneously, the controller 40 configures the solvent-supplying passage described earlier, and supplies the solvent from the solvent tank 20 to the outer tub 1 until a predetermined amount of the solvent is thereby stored.

When it is determined from the output signal of the normal level switch 19*a* that the solvent has reached the predetermined level, the supply valve VL1 is closed and the drainage valve VL2 is opened. This makes the solvent stored in the outer tub 1 to circulate through the drainage line 4, the drainage valve VL2, the pump 21, the first three-way valve VL3, the solvent filter 23, the solvent cooler 24, the second three-way valve VL4, and back to the solvent tank 20. While the drum 2 is rotated back and forth to beat the laundry articles, the solvent circulates as described above, where the button trap 19 catches any object coming off the laundry articles and the solvent filter 23 removes impurities from the solvent. During the washing process, a certain amount of soap is injected into the solvent so that it contains the soap at an appropriate concentration. This prevents the charging of the laundry articles as well as improves the washing performance. To inject the soap, the soap supply valve VL5 should be opened while the pump 21 running.

(2) Extracting Process (Step S2)

After a preset washing time, e.g. seven minutes, has elapsed, the controller 40 configures the solvent-supplying passage, as described earlier, to recover the solvent from the outer tub 1 to the solvent tank 20. Then, when it is determined from the output signal of the drainage level switch 19*b* that the solvent has been completely drained, the drum 2 is rotated in the forward direction at a high speed (e.g. 400-600 r.p.m.) During this process, the drainage operation is further continued so that the solvent extracted from the laundry articles returns to the solvent tank 20. After a preset extracting time has elapsed, the drum 2 is stopped to finish the extracting process.

(3) Water Repellent Finishing Process (Steps S3, S4)

After the completion of the extracting process, it is determined whether the water repellent finishing process is ordered (Step S3). If it is directed, the controller 40 performs the water repellent finishing process (Step S4) by activating the water repellent spray 28 to spray the water repellent into the drum 2 while rotating the drum 2 at a predetermined speed. The sprayed water repellent penetrates into the laundry articles contained in the drum 2. Step S4 is skipped if the water-repellent finishing process is not ordered.

(4) Recovering and Drying Process (Step S5 or S6)

Next, as the first phase of the drying process, the recovering and drying process is performed. In this process, the controller 40 energizes the blower motor 6, the heater 12 and the air cooler 15, while intermittently rotating the drum 2 back and forth at a low speed. The intake valve 9 and the exhaust valve 11 are closed, and the sluice valve 7 is opened. These valve settings create an air-circulating passage, where the air circulates from the inlet-side duct 3*a*, through the outer tub 1, the outlet-side duct 3*b* and the upper duct 3*c*, and back to the inlet-side duct 3*a*. Through the air-circulating passage, the air heated by the heater 12 is supplied into the outer tub 1 and enters the drum 2 through its perforations. In the drum 2, the hot air absorbs the gasified solvent evaporating from the laundry articles. Then, the hot air containing the gasified solvent reaches the air cooler 15, which cools the gasified solvent and condenses it into liquid. The air, which is now dry and solvent-free, returns to the heater 12 to be heated again, and then flows into the tub 1.

During the recovering and drying process, the controller performs a temperature control for maintaining the concentration of the gasified solvent in the air-circulating passage under the safety level. The concentration of the gasified solvent in the air-circulating passage depends on the temperature difference ?T=T1−T2, where T1 and T2 are the temperatures detected by the first and second temperature sensors 13 and 14, respectively. The temperature difference ?T corresponds to the decrease in the temperature of the air due to the evaporation of the solvent from the laundry articles. Accordingly, maintaining the temperature difference ?T under a predetermined value by appropriately controlling the mount of steam supplied to the heater 12 will make it possible to perform the drying process while maintaining the concentration of the gasified solvent in the air-circulating passage under the safety level.

The water repellent sprayed onto the laundry articles in the water-repellent finishing process in Step S4 consists of a small amount of water-repellent resin dissolved into a silicone solvent. This means that the laundry articles, from which the solvent has been extracted, are again supplied with the solvent when the water-repellent finishing process is performed. Therefore, compared to the case where the water-repellent finishing is not performed, the concentration of the gasified solvent is likely to be higher even if the same amount of heat is supplied during the recovering and drying process, meaning that the gasified solvent is more flammable. Taking this into account, in the present machine, the upper limit for the temperature difference ?T is set at 10 degrees centigrade if the water-repellent finishing process has been performed, whereas it is set at 20 degrees centigrade if the process has not been performed. Lowering the upper limit for the temperature difference ?T reduces the amount of heat supplied from the heater 12, which accordingly slows the evaporating speed of the solvent from the laundry articles. Thus, the concentration of the gasified solvent in the air-circulating passage can be assuredly maintained under the safety level. It should be noted, however, that the decrease in the evaporation speed of the solvent deteriorates the drying performance. Taking this into account, the period of time for the recovering and drying process is set longer when the water-repellent finishing process has been performed.

(5) Exhausting and Drying Process (Step S7)

After the recovering and drying process has been continued for a preset period of time, the operation enters the exhausting and drying process. In this process, the controller 40 opens the sluice valve 7, the intake valve 9 and the exhaust valve 11, while running the blower motor 6, the heater 12 and the air cooler 15. Then, a part of the air passing through the air cooler 15 is discharged through the exhaust port 10 to the outside, in exchange for which fresh air is externally introduced from the intake port 8. The fresh air merges into the circulating air, and the mixed air is heated by the heater 12 and supplied to the drum 2. In conventional dry-cleaning machines, the exhaust port is located upstream of the air cooler, so that the solvent contained in the air discharged from the exhaust port is emitted to the outside, without being recovered. In the present machine, on the other hand, the entire amount of air exiting from the drum 2 is assuredly cooled by the air cooler 15. Thus, the solvent contained in the air is efficiently recovered, while the amount of the solvent escaping through the exhaust port 10 is greatly reduced. Therefore, it is possible to decrease the replenishment of the costly silicone solvent, so that the running cost of the machine can be lowered.

(6) Cooling Down Process (Step S8)

After a preset period of time for the exhausting and drying process has elapsed, the operation enters the cooling down process. In this process, the intake valve 9 is closed, and the supply of steam to the heater 12 is discontinued to stop the heating, while rotating the drum 2 backwards. Then, the air cooled by the air cooler 15 is supplied into the drum 2 to cool the laundry articles.

(7) Deodorizing Process (Step S9)

After the cooling down process has been continued for a preset period of time, the air cooler 15 is deactivated, the intake valve 9 and the exhaust valve 11 are fully opened, and the sluice valve 7 is closed. This allows fresh air to be introduced through the intake port 8 into the inlet-side duct 3*a*. The fresh air flows through the outer tub 1 and the outlet-side duct 3*b*, and exits from the exhaust port 10 to the outside after passing the air cooler 15. In this process, the fresh air removes the residual smell of the solvent from the laundry articles. After the deodorizing process has been continued for a preset period of time, the drum 2 is stopped to complete the operation.

Other features of the dry-cleaning machines in the present embodiment are described.

Figure 4:
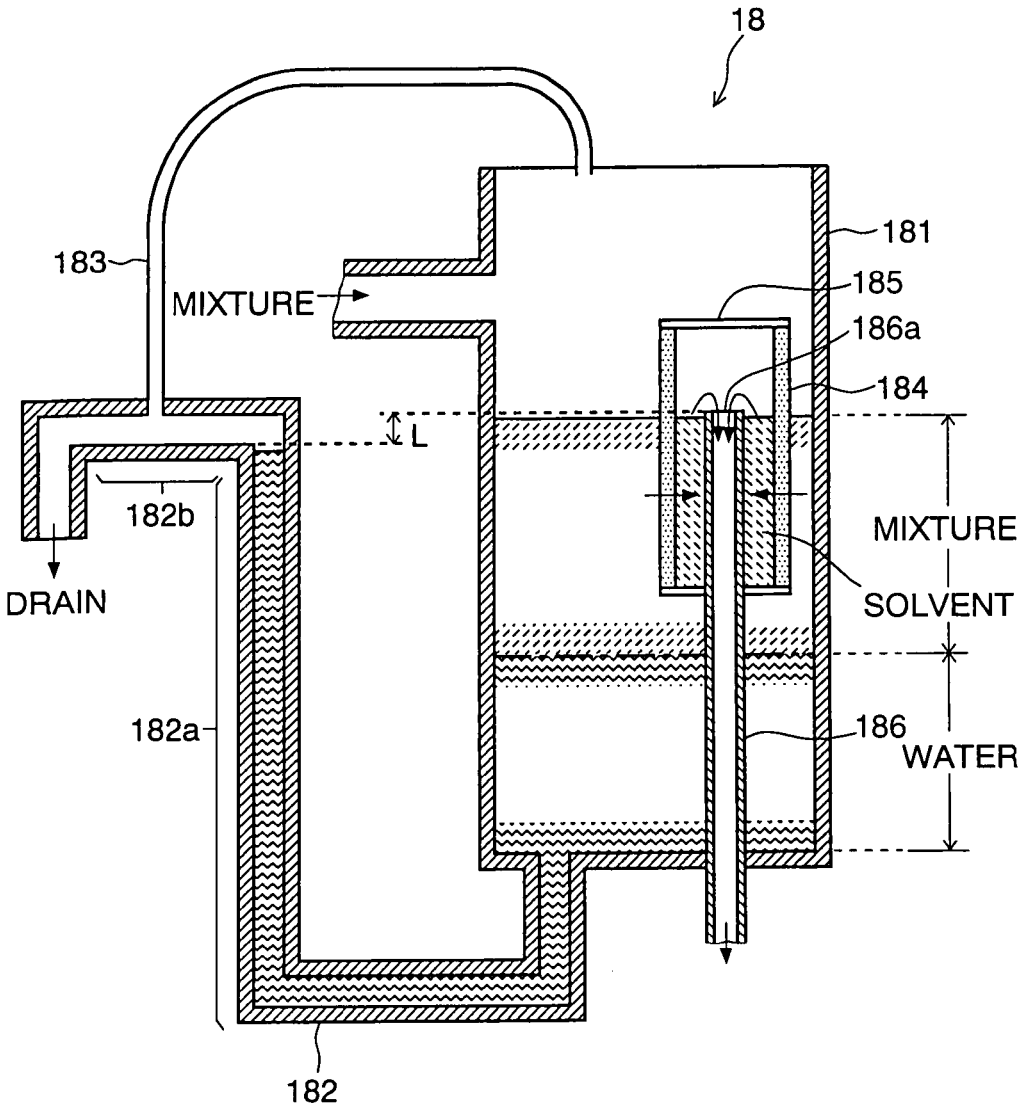
FIG. 4 is a vertical sectional view of the water separation unit used in the dry-cleaning machine of the embodiment.

FIG. 4 is a vertical sectional view of the water separation unit 18 of the present embodiment. In conventional dry-cleaning machines using petroleum solvents, water separation units simply separate water and solvent into two phases by using their difference in specific gravity. The present dry-cleaning machine uses a so-called coalescer type of liquid separation filter to rapidly separate silicone solvents whose specific gravity is close to that of water.

The water separation filter 18 includes a tank 181 for holding a mixture of the water and the solvent recovered from the drainage ports 17, and a drainage pipe 182 connected to the bottom of the tank 181. The drainage pipe 182 has a vertical part 182*a* and a horizontal part 182*b*. The horizontal part 182*b* is connected via a vent pipe 183 to the tank 181 to prevent the water from undesirably flowing through the drainage pipe to the outside due to a siphoning effect. Although the functional requirement for preventing this effect is to simply make the upper end of the vent pipe 183 open to the ambient air, the end is hereby connected to the tank 181 because the water may eject from the vent pipe 183 when it is drained from the tank 181.

The tank 181 encloses a cylindrical filter 184 consisting of a non-woven fabric made of superfine fibers with its upper and lower ends closed with the holders 185. The filter 184 encloses the upper end 186*a* of a solvent pipe 186 vertically penetrating through the bottom of the tank 181. The highest point within the drainage pipe 182 (that is, the horizontal part 182 in the present case) may be only slightly lower than the upper end 186*a* of the solvent pipe 186. In the present case, however, the lower side of the inner wall of the horizontal part 182*b* is located lower than the upper end 186*a* of the solvent pipe 186 by a level difference L determined on the basis of the difference in specific gravity between the water and the solvent. This ensures the mixture in the tank 181 to be maintained at a level where the filter 184 is always immersed in the mixture.

The mechanism of the water separation unit 18 separating water from silicone solvent is as follows. When the mixture is stored in the tank 181, the solvent mixed with the water attempts to pass through the filter 184. While the solvent is allowed to pass through the space between the fibers of the filter 184, the water cannot pass through the filter 184 and condenses itself into a large drop on the surface of the fibers. This is possible due to the difference in some properties, especially the surface tension, between the solvent and the water, and their relationship (or interaction) with the properties, especially the density, of the fiber filter 184. When the water drop has adequately grown, it falls because its specific gravity is greater than that of the solvent. Thus, the water is collected at the bottom of the tank 181. As the level of the mixture rises, the level of the solvent stored inside the filter 184 accordingly rises, and the solvent flows into the solvent pipe 186 when it reaches the upper end 186*a*. Meanwhile, the water collected at the bottom of the tank 186 is forced into the drainage pipe 182, where the level of the water in the drainage pipe 182 is constantly lower than that of the mixture by a certain amount due to the difference in specific gravity between the water and the solvent. As the level of the mixture rises, the level of the water in the drainage pipe 182 accordingly rises, and the water starts flowing to the outside when it has reached the horizontal part 182*b*.

Thus, the water is discharged from the drainage pipe 182, and the silicone solvent is discharged from the solvent pipe 186. Normally, the speed at which the filter 184 separates the two liquids is much faster than the speed at which the mixture flows. Therefore, the water and the solvent are assuredly separated at appropriate speeds corresponding to the amount of flow of the mixture flowing; so that the tank 181 will never be full. Since the vent pipe 183 prevents the siphoning effect, the drainage of water through the drainage pipe 182 assuredly stops when the water in the drainage pipe 182 comes to a level lower than the horizontal part 182*b* according to the lowering of the level of the mixture.

Figure 5:
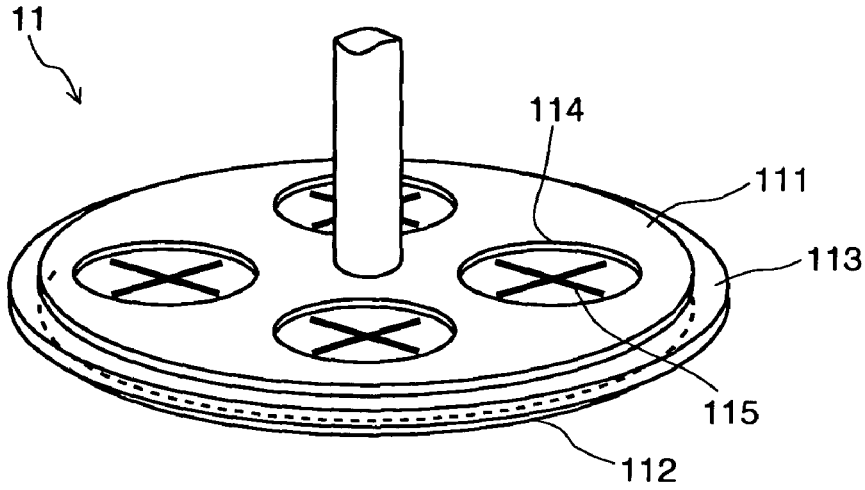
FIG. 5 is a perspective view of the exhaust valve used in the dry-cleaning machine of the embodiment.
Figure 6A:
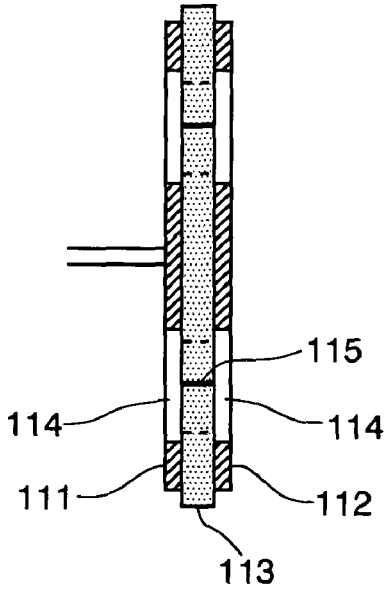
FIGS. 6A and 6B are sectional views of the exhaust valve schematically showing the operation of the valve.
Figure 6B:
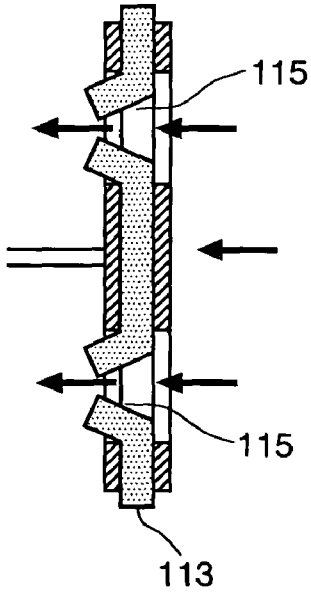

FIG. 5 is a perspective view of the exhaust valve 11 for closing the exhaust port 10 in the dry-cleaning machine of the present invention, and FIGS. 6A and 6B are sectional views of the exhaust valve 11 schematically showing the operation of the valve 11.

Conventional dry-cleaning machines generally have no exhaust valve for closing the exhaust port. In the present machine, however, exhaust valve 11 is used to close the exhaust port 10 when the air-circulating passage is configured so that the amount of the solvent escaping from the machine is minimized. If, however, the exhaust port 10 is completely closed with the exhaust valve 11, the air-circulating passage becomes a completely closed space, so that the damage from the explosion would be very pronounced if the gasified solvent should explode in the air-circulating passage. Taking this into account, the exhaust valve 11 in the present machine is constructed as described below.

That is, the exhaust valve 11 consists of a disc-shaped felt body 113 inserted between a pair of disc-shaped iron plates 111 and 112. Each of the iron plates 111 and 112 has circular openings 114 arranged at predetermined locations, through which the felt body 113 is exposed. This means that the felt body 113 functions as a valve at the opening 114. The part of the felt body 113 located in the opening 114 has a cross-like slit (or cut) 115.

In a normal condition, the slit 115 is closed because of the elasticity of the felt body 113, thus functioning as a valve that barely allows air to pass. If, for example, the gasified solvent should explode in the air-circulating passage configured as described earlier, the gas pressure instantaneously rises to abnormally high levels. Then, as shown in FIG. 6B, the slit 115 is pushed open and outward by the differential pressure between the inside and the outside of the felt body 113, and the gas is released through the slit 115 to the outside. Thus, the slit 115 functions as an explosion relief mechanism when the gas pressure has risen to abnormally high levels, whereby the damage could be minimized if an explosion should occur.

Finally, it should be noted that the above-described embodiment is a mere example of the present invention, which can be changed or modified within the spirit and scope of the present invention.

What is claimed is:

1. A dry-cleaning machine for performing a drying process whereby hot air is supplied into a drying tub containing laundry articles washed with a solvent, and an air exiting from the drying tub is cooled to liquefy, condense and recover a gasified solvent contained in the air, comprising:

(i) a water separation unit for removing water from a mixture of the liquefied and condensed solvent and the water to recover the solvent with a high level of purity, where a coalescer type of filter is used as the water separation unit, the water separation unit including a tank for storing the mixture, the tank having an inlet port located in its upper part for introducing the mixture;

a filter member immersed in the mixture stored in the tank, where the solvent is stored in a solvent storage chamber defined on one side of the filter member opposite to the mixture, and the filter member allows only the solvent contained in the mixture to pass through into the solvent storage chamber, the filter member comprising a plurality of fibers, wherein the coalescer type of filter allows the solvent to pass through the fibers of the filter member, whereas the water is condensed into large drops and the water drops are collected at the bottom of the tank (ii) a solvent recovery pipe with its upper end located in the solvent storage chamber; and (iii) a drainage pipe connected to a bottom part of the tank, including:

a vertical part for bringing the water from the tank to a level higher than the bottom part of the tank, and a horizontal part located downstream of the vertical part, where the highest point within the horizontal part is lower than the upper end of the solvent recovery pipe.

2. The dry-cleaning machine according to claim 1, wherein the solvent is a silicone solvent, and a difference in level between the horizontal part of the drainage pipe and the upper end of the solvent recovery pipe is determined corresponding to a difference in specific gravity between the silicone solvent and the water.

3. The dry-cleaning machine according to claim 2, wherein the horizontal part of the drainage pipe is provided with a hole leading to an ambient air.

4. The dry-cleaning machine according to claim 3, wherein the hole is connected to the upper part of the tank by a vent pipe.

* * * * *